US010845737B2

(12) United States Patent
Takai

(10) Patent No.: US 10,845,737 B2
(45) Date of Patent: Nov. 24, 2020

(54) IMAGE FORMING APPARATUS AND TRANSFER DEVICE

(71) Applicant: Naoki Takai, Tokyo (JP)

(72) Inventor: Naoki Takai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/655,593

(22) Filed: Oct. 17, 2019

(65) Prior Publication Data

US 2020/0133173 A1 Apr. 30, 2020

(30) Foreign Application Priority Data

Oct. 30, 2018 (JP) ..... 2018-203785

(51) Int. Cl.
*G03G 15/16* (2006.01)
*G03G 15/00* (2006.01)
*G03G 21/16* (2006.01)

(52) U.S. Cl.
CPC ..... *G03G 15/1615* (2013.01); *G03G 15/6558* (2013.01); *G03G 21/1695* (2013.01)

(58) Field of Classification Search
CPC ..... G03G 15/1615; G03G 15/6555; G03G 15/6558; G03G 21/168; G03G 21/1695; G03G 2215/00409; G03G 2221/1642
See application file for complete search history.

(56) References Cited

U.S. PATENT DOCUMENTS 5,771,428 A * 6/1998 Marumoto ..... G03G 15/6558 399/110
5,923,935 A * 7/1999 Yamaguchi ..... G03G 21/168 399/121
2006/0093397 A1* 5/2006 Yamaoka ..... G03G 15/165 399/110
2015/0248099 A1 9/2015 Sakashita et al.
2017/0097589 A1 4/2017 Seki et al.
2017/0139353 A1 5/2017 Sakashita et al.

FOREIGN PATENT DOCUMENTS

JP 2001-166613 6/2001
JP 2001-205894 7/2001
JP 2003-072677 3/2003
JP 2010-261217 11/2010

* cited by examiner

*Primary Examiner* — Sophia S Chen
(74) *Attorney, Agent, or Firm* — Harness, Dickey & Pierce, P.L.C.

(57) ABSTRACT

An image forming apparatus includes a conveyance device configured to transport a conveyed object, a conveyance guide configured to guide the conveyed object to the conveyance device, a housing including a shaft support. The conveyance guide includes a rotation shaft that includes a non-circular shaft portion. The shaft support has a circular hole part and a guide slot. The circular hole part is configured to rotatably support the rotation shaft, and the rotation shaft is inserted into the shaft support through the guide slot while a flat surface of the non-circular shaft portion slides along a guide surface of the guide slot. The image forming apparatus further includes a restrictor configured to restrict movement of the rotation shaft inserted into the circular hole part of the shaft support in a direction opposite to a direction of insertion of the rotation shaft into the shaft support.

20 Claims, 10 Drawing Sheets

IMAGE FORMING APPARATUS AND TRANSFER DEVICE

CROSS-REFERENCE TO RELATED APPLICATION

This patent application is based on and claims priority pursuant to 35 U.S.C. § 119(a) to Japanese Patent Application No. 2018-203785, filed on Oct. 30, 2018, in the Japan Patent Office, the entire disclosure of which is hereby incorporated by reference herein.

BACKGROUND

Technical Field

Embodiments of the present disclosure generally relate to an image forming apparatus and a transfer device.

Description of the Related Art

Image forming apparatuses generally includes various conveyance mechanisms to transport a conveyed object at the time of image formation. In some image forming apparatuses, a conveyance unit including at least a part of the conveyance mechanism and a conveyance guide that guides the conveyed object to the conveyance mechanism is installed in a housing of the image forming apparatus.

SUMMARY

Embodiments of the present disclosure describe an improved image forming apparatus that includes a conveyance device configured to transport a conveyed object, a conveyance guide configured to guide the conveyed object to the conveyance device, a housing including a shaft support. The conveyance guide includes a rotation shaft that includes a non-circular shaft portion. The shaft support has a circular hole part and a guide slot. The circular hole part is configured to rotatably support the rotation shaft, and the rotation shaft is inserted into the shaft support through the guide slot while a flat surface of the non-circular shaft portion slides along a guide surface of the guide slot. The image forming apparatus further includes a restrictor configured to restrict movement of the rotation shaft inserted into the circular hole part of the shaft support in a direction opposite to a direction of insertion of the rotation shaft into the shaft support.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
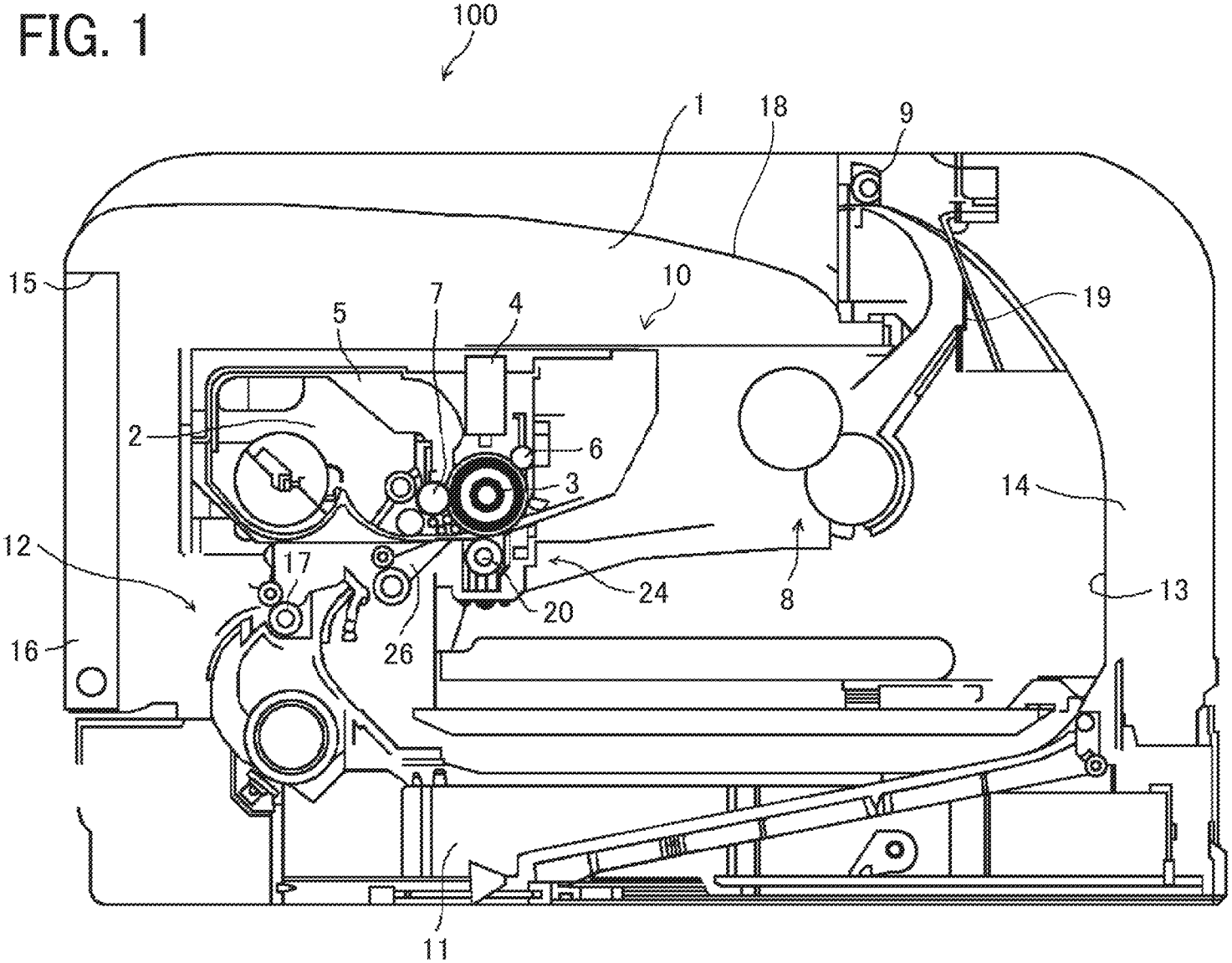
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

Hereinafter, descriptions are given below in detail of an image forming apparatus and a transfer device according to embodiments of the present disclosure, with reference to the accompanying drawings. In the present embodiment, the image forming apparatus including the transfer device is a printer.

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

FIG. 1 is a schematic view illustrating a configuration of an image forming apparatus 100 according to an embodiment of the present disclosure. In this embodiment, the image forming apparatus 100 illustrated in FIG. 1 is a monochrome direct transfer printer that employs an electrophotographic method in which a recording sheet is fed through a horizontal path. The image forming apparatus 100 includes a housing 1. A process cartridge 2 is installed in a substantially center part of the housing 1 of the image forming apparatus 100. The process cartridge 2 includes a photoconductor drum 3, an exposure device 4, a developing device 5, and a charger 6.

The photoconductor drum 3 is pressed against the roller-shaped charger 6. The charger 6 is driven to rotate along with the rotation of the photoconductor drum 3. A high-voltage power source applies a bias to the charger 6, thereby charging a surface of the photoconductor drum 3 uniformly. The bias can be a direct-current (DC) voltage or a superimposed voltage in which an alternating-current (AC) voltage is superimposed on the DC voltage.

The exposure device 4 is disposed above the photoconductor drum 3. The exposure device 4 exposes the photoconductor drum 3 based on image data, thereby forming an electrostatic latent image on the surface of the photoconductor drum 3. This exposure process is performed by, for example, a laser beam scanner using a laser diode or light-emitting diode (LED) arrays. The developing device 5 includes a developing roller 7 that causes toner to adhere to the photoconductor drum 3. The developing device 5 develops the electrostatic latent image formed on the photoconductor drum 3 with toner into a toner image.

The photoconductor drum 3, the developing device 5, and the charger 6 are combined together to form a removable drum unit 10.

The image forming apparatus 100 includes a conveyance unit 24 below the photoconductor drum 3. The conveyance unit 24 includes a transfer roller 20 as a transferor to form a transfer portion (transfer nip) between the photoconductor drum 3 and the transfer roller 20. The conveyance unit 24 serves as the transfer device together with the housing 1. The transfer device according to the present embodiment controls a transfer function of the image forming apparatus 100.

The transfer roller 20 also functions as a conveyance device to transport a recording sheet together with the photoconductor drum 3. In addition, the conveyance unit 24 includes a conveyance guide 26 to guide the recording sheet to the transfer portion. A high voltage is applied to the transfer roller 20, and the toner image formed on the surface of the photoconductor drum 3 is transferred to the recording sheet as a conveyed object due to a potential difference between the photoconductor drum 3 and the transfer roller 20. It is to be noted that, instead of the transfer roller 20, a transfer charger that applies reverse charges opposite in polarity to toner may be used as the transferor.

The image forming apparatus 100 includes a fixing device 8 positioned downstream from the process cartridge 2 in a direction of conveyance of the recording sheet (hereinafter, also referred to as "sheet conveyance direction". The fixing device 8 applies heat and pressure to the recording sheet bearing the toner image to fix the toner image on the recording sheet while passing the recording sheet between two rollers of the fixing device 8.

The image forming apparatus 100 further includes a sheet ejection device 9 downstream from the fixing device 8 in the sheet conveyance direction. The sheet ejection device 9 ejects the recording sheet to an output tray 18 on the upper surface of the image forming apparatus 100. Further, the image forming apparatus 100 includes a sheet sensor 19 on a conveyance path from the fixing device 8 to the sheet ejection device 9, to confirm the status of the recording sheet transported through the conveyance path. The image forming apparatus 100 can confirm the arrival time of the leading edge, the passage time, and the position of the recording sheet on the conveyance path based on output from the sheet sensor 19.

The image forming apparatus 100 includes a sheet tray 11 disposed below the transfer roller 20 and at the lower part of the image forming apparatus 100, to store a stack of recording sheets. Further, the image forming apparatus 100 includes a sheet feeding device 12 adjacent to the sheet tray 11 to pick up the recording sheet from the sheet tray 11 one by one.

The sheet feeding device 12 includes a registration roller pair 17 that controls the timing of feeding of the recording sheet so that the recording sheet is timed to coincide with the arrival of the toner image on the photoconductor drum 3 to transfer the toner image onto the recording sheet. The sheet feeding device 12 transports the recording sheet, which is picked up from the sheet tray 11 and fed at the proper timing by the registration roller pair 17, to the transfer portion between the photoconductor drum 3 and the transfer roller 20.

In the image forming apparatus 100, a wall surface of the housing 1 has an opening 13 in a region opposite the fixing device 8. Further, the image forming apparatus 100 includes a rear cover 14 that covers the opening 13 and can be opened and closed. A user can access the conveyance path from the fixing device 8 to the sheet ejection device 9 when opening the rear cover 14. The user can remove the fixing device 8 from the housing 1 when opening the rear cover 14.

In addition, in the image forming apparatus 100, another wall surface of the housing 1 has an opening 15 in a region opposite the drum unit 10. Further, the image forming apparatus 100 includes a front cover 16 that covers the opening 15 and can be opened and closed. A user can remove the recording sheet jammed in the image forming apparatus 100, or can install or remove the drum unit 10 through the opening 15 when opening the front cover 16. Further, the user can replace the transfer roller 20 after removing the drum unit 10. The replacement of the transfer roller 20 is described later. The front cover 16 can also serve as a bypass tray to supply the recording sheet from outside the housing 1 of the image forming apparatus.

With such a configuration, image formation is performed in the image forming apparatus 100 as follows. The sheet feeding device 12 transports the recording sheet, which is picked up from the sheet tray 11, via a registration roller pair 17 to the transfer portion between the photoconductor drum 3 and the transfer roller 20. After the toner image is transferred to the recording sheet, the recording sheet is transported to the fixing device 8 to fix the toner image on the recording sheet. After the toner image is fixed thereon, the recording sheet is ejected to the output tray 18 on the upper surface of the image forming apparatus 100 by the sheet ejection device 9.

Next, the conveyance unit 24 including the transfer roller 20 opposed to the photoconductor drum 3 of the drum unit 10 is described.

Figure 2:
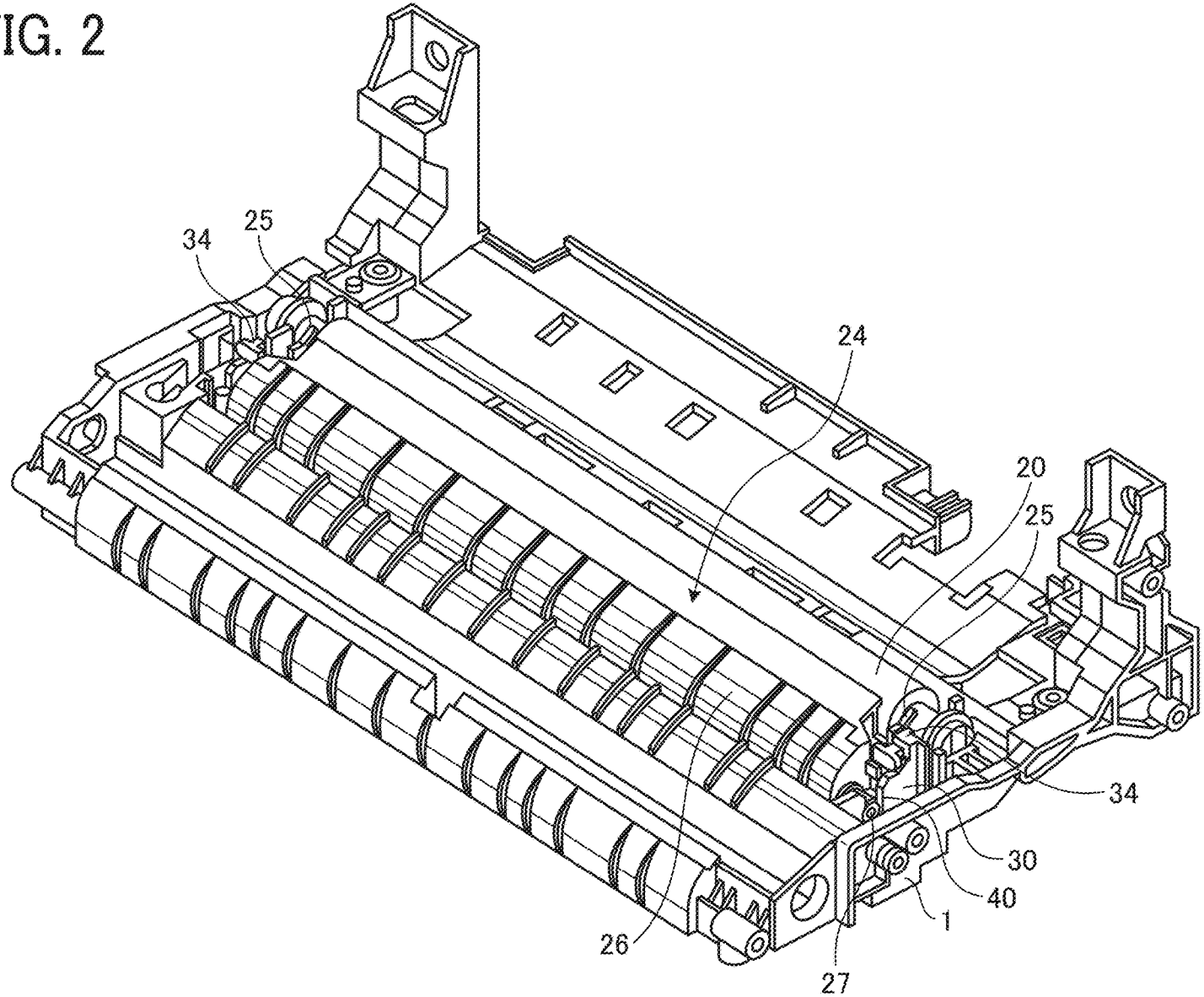
FIG. 2 is a perspective view of a conveyance unit of the image forming apparatus in FIG. 1 as viewed from obliquely above.
Figure 3:
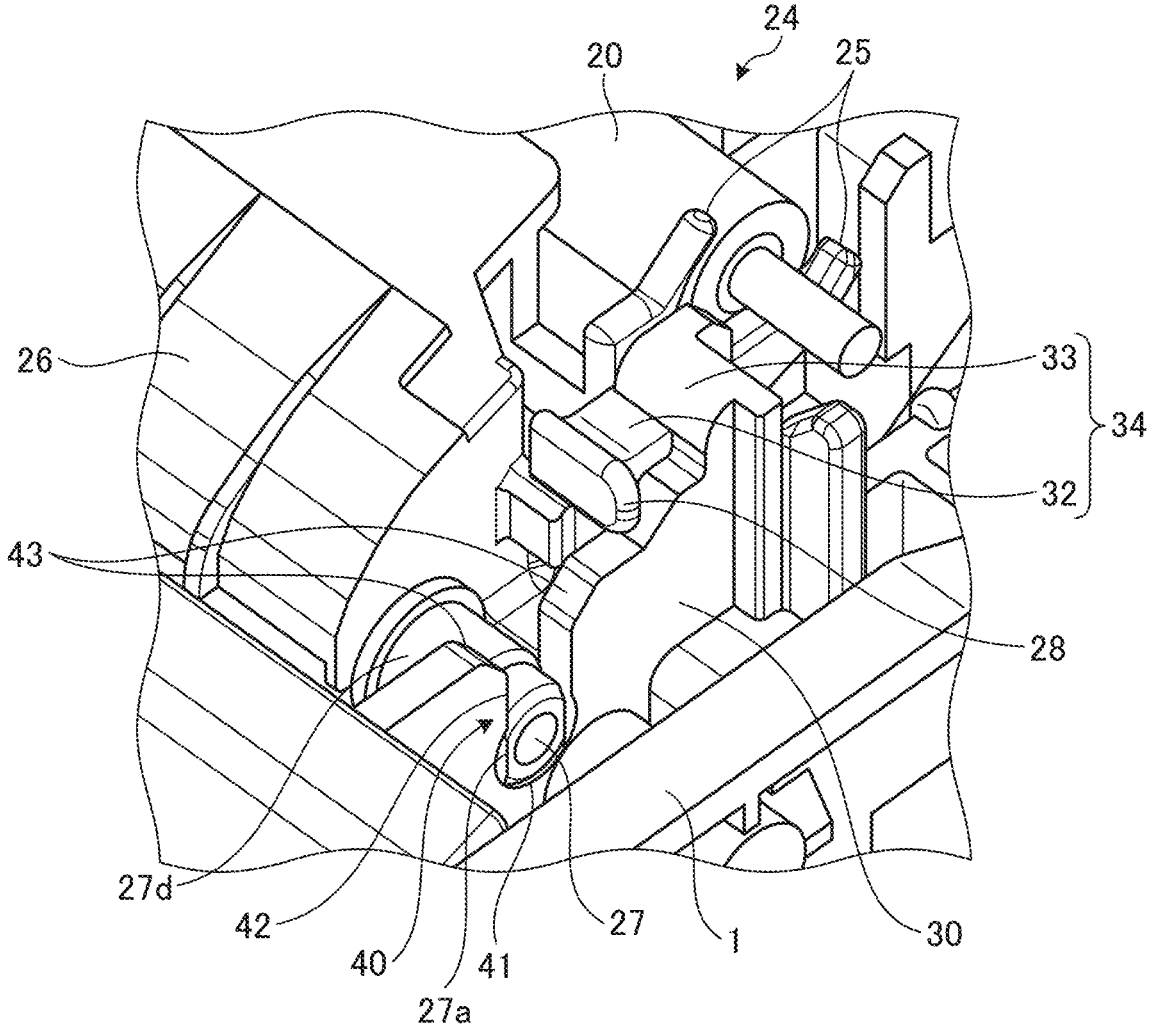
FIG. 3 is an enlarged perspective view of a rotation shaft of the conveyance unit in FIG. 2 and the surrounding structure.
Figure 4:
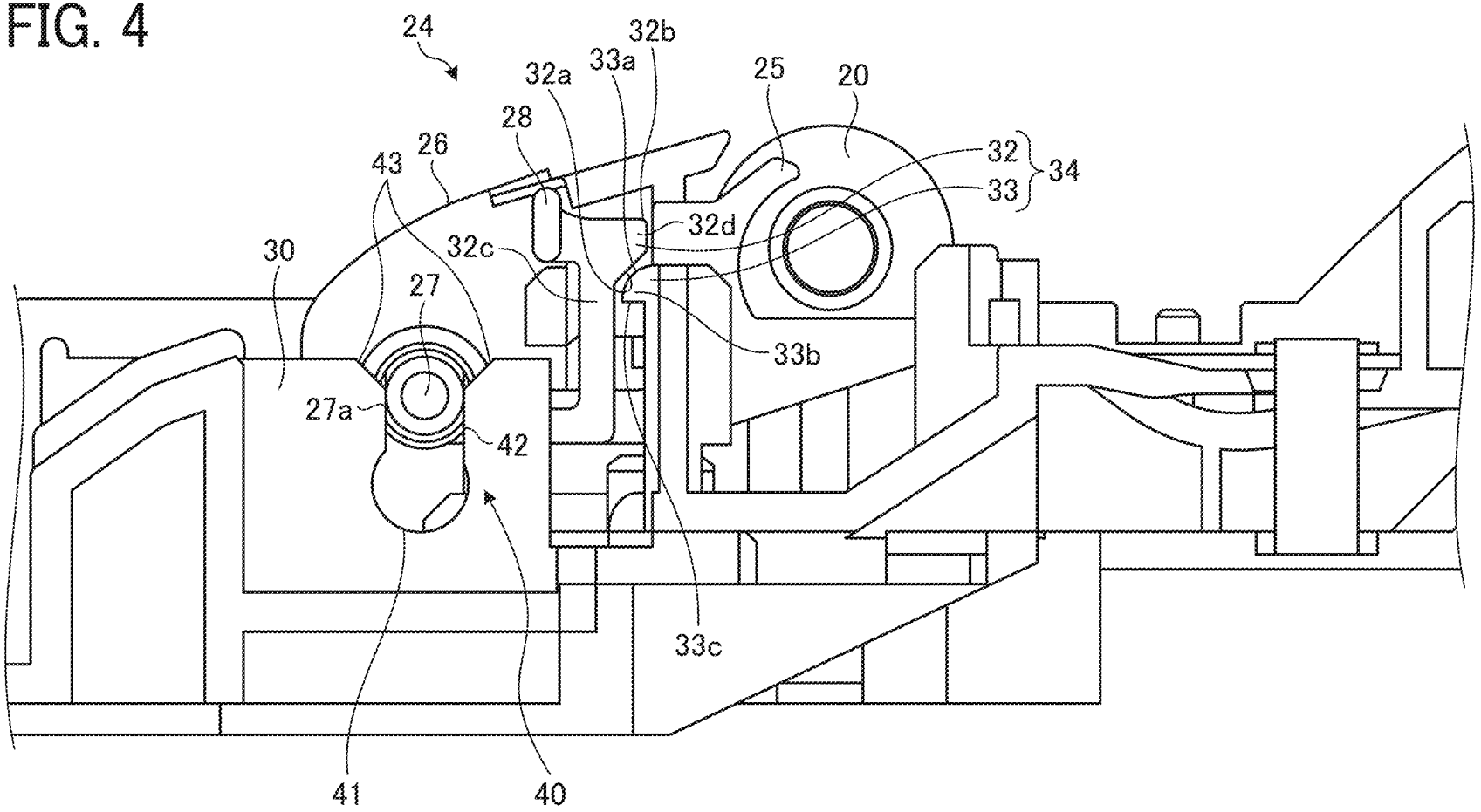
FIG. 4 is a side view of the conveyance unit immediately before being installed in a housing of the image forming apparatus.
Figure 5:
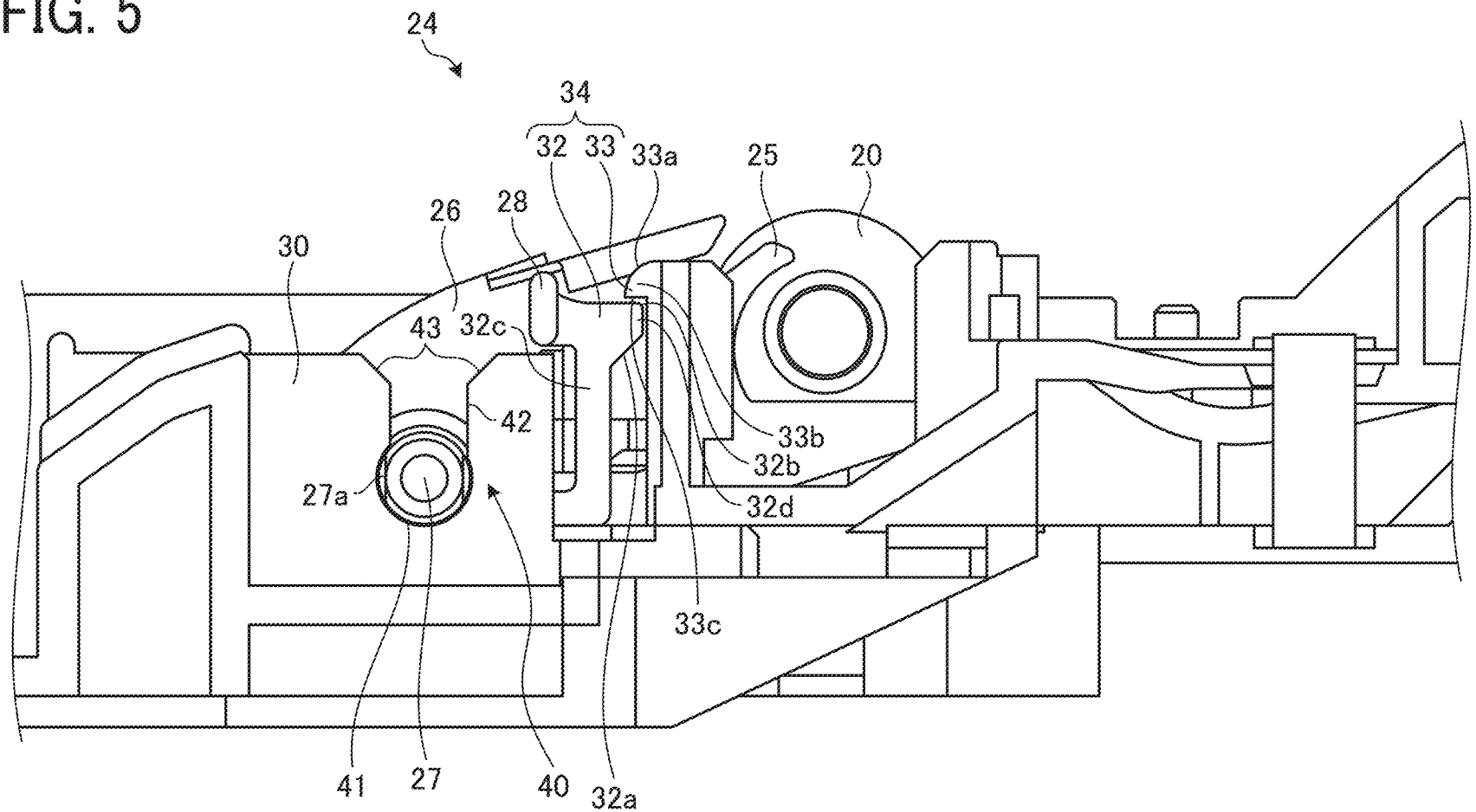
FIG. 5 is a side view of the conveyance unit after installation in the housing.

FIG. 2 is a perspective view of the conveyance unit 24 as viewed from obliquely above. FIG. 3 is an enlarged perspective view of a rotation shaft 27 of the conveyance unit 24 in FIG. 2 and the surrounding structure. FIG. 4 is a side view of the conveyance unit 24 immediately before being installed in the housing 1. FIG. 5 is a side view of the conveyance unit 24 after the conveyance unit 24 is installed in the housing 1. As illustrated in FIGS. 2 and 3, the conveyance unit 24 includes the conveyance guide 26 including an arm 25 and the rotation shaft 27, and the transfer roller 20. The rotation shaft 27 serves as a rotation fulcrum of the conveyance guide 26. As illustrated in FIG. 2, the rotation shaft 27 is rotatably supported by a shaft support 40 of the housing 1.

The conveyance guide 26 has a narrow band shape (plate shape) having a width that matches to the maximum width of the recording sheet, and is curved with a certain curvature radius at the upstream end of the conveyance guide 26 in the sheet conveyance direction. Further, the conveyance guide 26 has the same width as the transfer roller 20 and guides the recording sheet to the transfer portion. The arms 25 are disposed at both ends of the conveyance guide 26 in the width direction and support the transfer roller 20. The arms 25 and the conveyance guide 26 are rotatable around the rotation shaft 27. That is, the transfer roller 20 is supported downstream from the conveyance guide 26 in the sheet conveyance direction.

Note that paper dust and toner accumulate on the surface of the transfer roller 20. Therefore, the transfer roller 20 is a component that is replaceable. The conveyance guide 26 and the transfer roller 20 are positioned as close together as possible to prevent the recording sheet from entering between the conveyance guide 26 and the transfer roller 20 (i.e., a predetermined position). More specifically, a downstream end of the conveyance guide 26 is positioned downstream from an upstream end of the transfer roller 20 in the sheet conveyance direction and below an uppermost portion of the transfer roller 20, thereby preventing the recording sheet from jamming. Meanwhile, when the conveyance guide 26 is positioned at the predetermined position, the transfer roller 20 and the conveyance guide 26 do not contact each other. This configuration does not affect the conveyance function of the conveyance guide 26 and the pressing force of the transfer roller 20 against the photoconductor drum 3.

Figure 6:
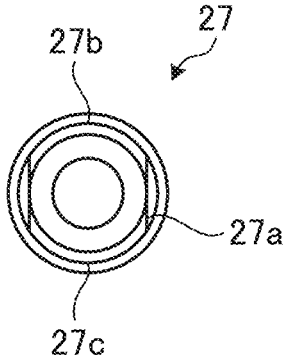
FIG. 6 is a side view of the rotation shaft that rotates together with a conveyance guide of the conveyance unit.
Figure 7:
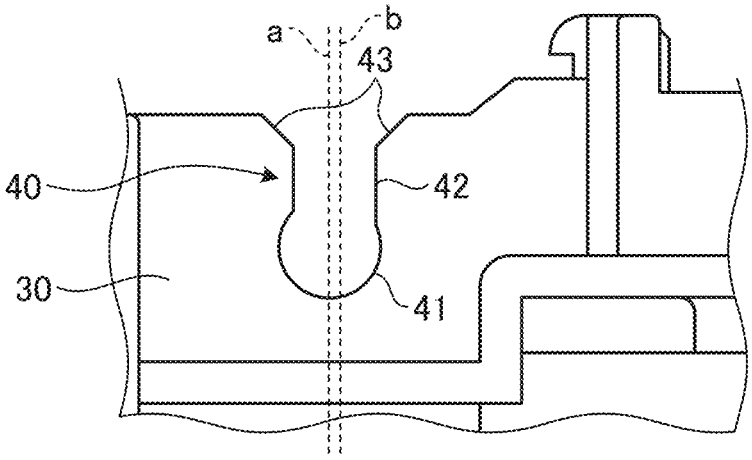
FIG. 7 is a side view of a shaft support of the housing into which the rotation shaft is inserted.

FIG. 6 is a side view of the rotation shaft 27 that rotates together with the conveyance guide 26. FIG. 7 is a side view of the shaft support 40 into which the rotation shaft 27 is inserted. As illustrated in FIG. 6, the rotation shaft 27 includes a non-circular shaft portion 27*a* that has a pair of flat surfaces parallel to each other on opposite sides of the rotation shaft 27. The non-circular shaft portion 27*a* is attached to a short cylindrical shaft portion 27*d* of the rotation shaft 27 that projects from the conveyance guide 26. The two flat surfaces are formed by, for example, cutting or molding (i.e., I-shape shaft). Here, a width of the non-circular shaft portion 27*a* means a distance between the pair of flat surfaces. Upper and lower ends of the non-circular shaft portion 27*a* are curved surfaces 27*b* and 27*c*, respectively. The rotation shaft 27 is formed together with the conveyance guide 26 as a single unit. Since the rotation shaft 27 includes the non-circular shaft portion 27*a*, the rotation shaft 27 can be inserted into a guide slot 42 to be described later (see FIG. 7) in a predetermined direction (direction perpendicular to the width direction of the non-circular shaft portion 27*a*), that is, from top to bottom. The non-circular shaft portion 27*a* of the rotation shaft 27 uniquely determines the posture of the conveyance guide 26 when the conveyance guide 26 is installed in the housing 1. In the present embodiment, the non-circular shaft portion 27*a* of the rotation shaft 27 has the two flat surfaces. However, the shape of the non-circular shaft portion 27*a* is not limited to I-shape and may be D-shape that has one flat surface in the direction of axis of the rotation shaft 27 (i.e., D-shape shaft).

As illustrated in FIG. 7, the shaft support 40 has a circular hole part 41 to rotatably support the rotation shaft 27, the guide slot 42 to guide the non-circular shaft portion 27*a* of the rotation shaft 27, and a tapered portion 43 to draw the rotation shaft 27 into the guide slot 42. The guide slot 42 has a guide surface along which the rotation shaft 27 is inserted into and removed from the circular hole part 41. The shaft support 40 is formed together with a frame 30 that is a part of the housing 1.

As illustrated in FIG. 7, the guide slot 42 has a width corresponding to the width of non-circular shaft portion 27*a* so that the non-circular shaft portion 27*a* of the rotation shaft 27 can be inserted and removed through the guide slot 42. The circular hole part 41 has a circular shape that communicates with the guide slot 42. The circular hole part 41 supports the rotation shaft 27 rotatable along the arc of the circular hole part 41.

As illustrated in FIG. 7, the center of the circular hole part 41 is offset from the center of the guide slot 42 in the width direction of the guide slot 42. Specifically, a center line a of the circular shape of the circular hole part 41 parallel to the direction of insertion of the non-circular shaft portion 27*a* is offset from a center line b of the guide slot 42 parallel to the direction of insertion of the non-circular shaft portion 27*a*. More specifically, the center line a of the circular hole part 41 is offset to the upstream side of the center line b of the guide slot 42 in the sheet conveyance direction.

The flat surfaces of the non-circular shaft portion 27*a* of the rotation shaft 27 of the conveyance guide 26 and the guide surfaces of the guide slot 42 are opposed to each other, and the conveyance guide 26 is moved in parallel along the guide slot 42, thereby inserting the rotation shaft 27 into the shaft support 40.

As illustrated in FIGS. 4 and 5, the image forming apparatus 100 includes a position restrictor 34. The position restrictor positions the conveyance guide 26 of the conveyance unit 24 at the predetermined position suitable for the conveyance guide 26 to guide the recording sheet to the transfer portion, and restricts movement of the conveyance guide 26 relative to the frame 30 of the housing 1. The position restrictor 34 includes a pair of an engaged portion 32 of the conveyance guide 26 and an engagement portion 33, which engages the engaged portion 32, of the housing 1. The engaged portion 32 is disposed on at least one of both end portions of the conveyance guide 26 in the width direction. The engagement portion 33 is disposed on the frame 30 that is a part of the housing 1 so as to correspond to the engaged portion 32. Further, the engaged portion 32 of the conveyance unit 24 includes a lever 28. The lever 28 is disposed between the transfer roller 20 and the rotation shaft 27, and the non-circular shaft portion 27*a* of the rotation shaft 27 is positioned closer to the opening 15 than the transfer roller 20.

The position restrictor 34 employs a so-called snap fit method. Here, the term "snap-fit" means a method of mechanically coupling metal parts, plastic parts, and the like in which one part fits into another part using elasticity of the material. The coupling method according to the present embodiment is described in detail below.

Schematically, in the position restrictor 34, the engaged portion 32 fits into the engagement portion 33 using elasticity. Accordingly, the position restrictor 34 functions as a restrictor that inhibits the rotation shaft 27 inserted into the shaft support 40 from moving in the direction opposite to the direction of insertion of the rotation shaft 27 into the guide slot 42.

The engagement portion 33 includes an inclined portion 33*a* disposed at the upper portion of the engagement portion 33 and a claw 33*b* to hold an upper end 32*b* of the engaged portion 32 to restrict movement of the conveyance guide 26 (see FIG. 5). The claw 33*b* is provided with a barb 33*c* that forms a recess. On the other hand, the engaged portion 32 includes a pillar base 32*c* having elasticity and a projection 32*d* projecting in an eaves shape from the pillar base 32*c*. The projection 32*d* includes an upper end 32*b* disposed at the upper portion and an inclined portion 32*a* disposed at the lower portion of the projection 32*d*. The inclined portion 32*a* is gently inclined from the tip of the projection 32*d*. The inclined portion 32*a* is disposed at a position where the inclined portion 32*a* comes into contact with the inclined portion 33*a* of the engagement portion 33 as the non-circular shaft portion 27*a* of the rotation shaft 27 is inserted into the guide slot 42.

With this configuration of the position restrictor 34 described above, as the inclined portion 32*a* of the engaged portion 32 contacts the inclined portion 33*a* of the engagement portion 33, the inclined portion 32*a* of the engaged portion 32 moves with respect to the inclined portion 33*a* of the engagement portion 33. As a result, the engaged portion 32 is displaced (bent) by elasticity. Further, in the position restrictor 34, when the projection 32*d* of the engaged portion 32 has passed through the inclined portion 33*a* of the engagement portion 33, the engaged portion displaced in the direction indicated by arrow B in FIG. 8B returns to the original shape, in which the engaged portion 32 is not displaced, of the engaged portion 32. As a result, the barb 33*c* of the engagement portion 33 hooks on the upper end 32*b* of the engaged portion 32. Note that, the engaged portion 32 may be displaced by rubber elasticity.

Next, a configuration that can position the conveyance unit 24 at the predetermined position of the housing 1 is described.

Figure 8A:
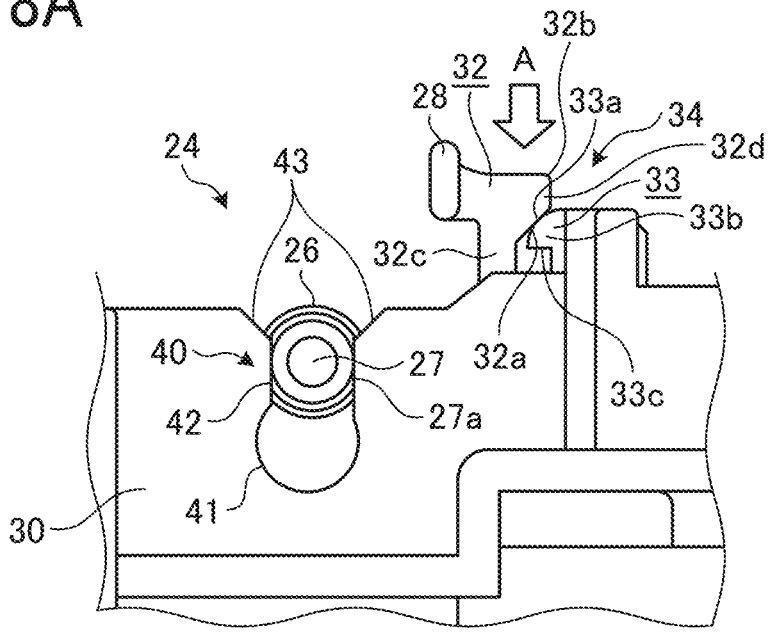
FIG. 8A is a schematic view illustrating a state immediately after start of installation of the conveyance unit in the housing.
Figure 8B:
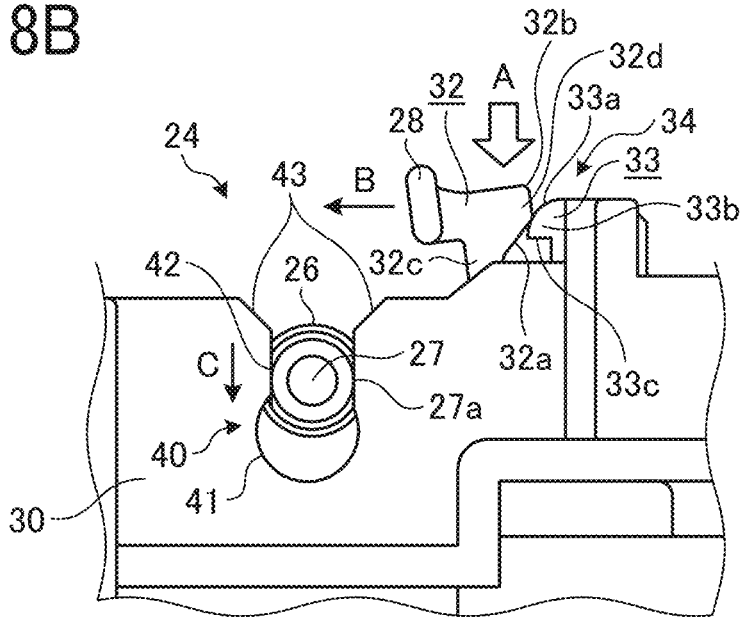
FIG. 8B is a schematic view illustrating a state during installation of the conveyance unit in the housing.
Figure 8C:
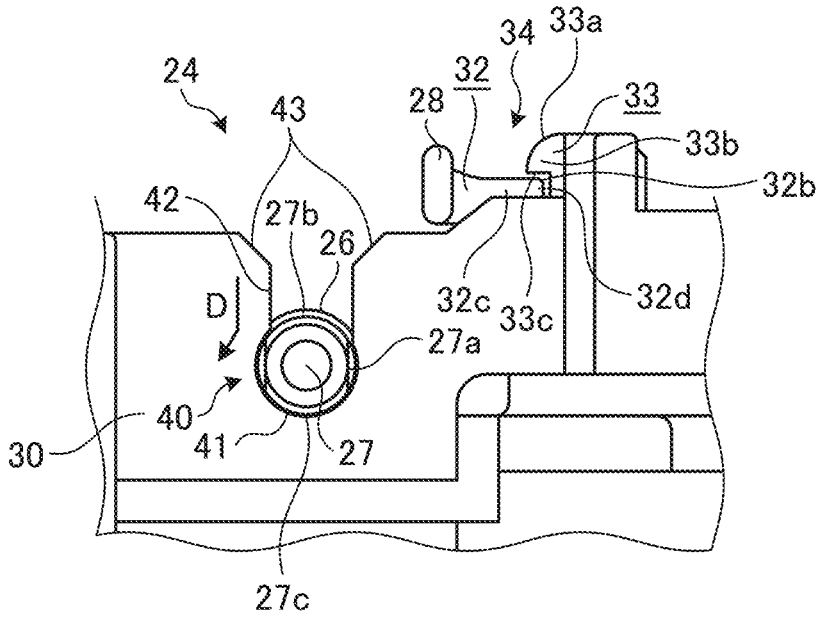
FIG. 8C is a schematic view illustrating a state after installation of the conveyance unit in the housing.

FIGS. 8A to 8C are schematic views illustrating a process of installing the conveyance unit 24 in the housing 1. In the present embodiment, the conveyance guide 26 is positioned at the predetermined position as follows.

FIG. 8A is a schematic view illustrating a state immediately after start of installing the conveyance unit 24 in the housing 1. As illustrated in FIG. 8A, when the conveyance unit 24 is installed in the housing 1 in a state in which the drum unit 10 (see FIG. 1) is removed from the housing 1, a user inserts the conveyance unit 24 through the opening 15 into the housing 1 in a horizontal position (i.e., in the same posture when the conveyance guide 26 guides the recording sheet to the transfer roller 20). Then, the user inserts the rotation shaft 27 of the conveyance guide 26 from above as indicated by arrow A in FIG. 8A into the shaft support 40.

FIG. 8B is a schematic view illustrating a state during installation of the conveyance unit 24 in the housing 1. As illustrated in FIG. 8B, as the rotation shaft 27 of the conveyance guide 26 is further inserted into the shaft support 40 from above as indicated by arrow A in FIG. 8B, the rotation shaft 27 of the conveyance guide 26 is guided to the circular hole part 41 in the direction indicated by arrow C so that the pair of flat surfaces of the non-circular shaft portion 27*a* is guided along the guide surfaces of the guide slot 42 of the shaft support 40. In this process, when the inclined portion 32*a* disposed on the lower surface of the projection 32*d* of the engaged portion 32 is about to move downward, the incline portion 32*a* receives the reaction force in the diagonally upper left direction from the inclined portion 33*a* of the engagement portion 33. As a result, the engaged portion 32 is pressed and displaced in the direction indicated by arrow B in FIG. 8B. That is, in the present embodiment, the barb 33*c* that forms the recess of the engagement portion 33 engages the projection 32*d* of the engaged portion 32 having flexibility in conjunction with the movement of the non-circular shaft portion 27*a* of the rotation shaft 27 with respect to the shaft support 40.

FIG. 8C is a schematic view illustrating a state after installation of the conveyance unit 24 in the housing 1. As illustrated in FIG. 8C, when the projection 32*d* of the engaged portion 32 has passed through the inclined portion 33*a* of the engagement portion 33, the engaged portion 32 displaced in the direction indicated by arrow B in FIG. 8B returns to the original shape of the engaged portion 32. As a result, the barb 33*c* of the engagement portion 33 hooks on the upper end 32*b* of the engaged portion 32. Accordingly, the conveyance guide 26 is hold in the frame 30. As a result, the projection 32*d* of the engaged portion 32 engages the barb 33*c* that forms the recess of the engagement portion 33, that is, the position restrictor 34 restricts the position of the conveyance guide 26. Therefore, as illustrated in FIG. 8C, the conveyance guide 26 is positioned at the predetermined position.

Further, as illustrated in FIG. 8C, as the conveyance guide 26 is positioned at the predetermined position, the rotation shaft 27 of the conveyance guide 26 has been completely guided to the circular hole part 41 of the shaft support 40. Here, as illustrated in FIG. 7, since the center line a of the circular hole part 41 is offset from the center line b of the guide slot 42, when the engaged portion 32 moves back in the direction opposite to the direction indicated by arrow B in FIG. 8B, the rotation shaft 27 in the shaft support 40 moves in the direction indicated by arrow D in FIG. 8C. As a result, the center of the rotation shaft 27 is positioned in the circular hole part 41 of the shaft support 40 with deviation from the center line b.

In such a state, as illustrated in FIG. 8C, the flat surfaces of the non-circular shaft portion 27*a* of the rotation shaft 27 of the conveyance guide 26 are parallel to the guide surfaces of the guide slot 42 of the shaft support 40. This state is called a first installation position. The first installation position is a state in which the conveyance guide 26 can guide the recording sheet to the transfer roller 20.

At the first installation position, the position restrictor 34 restricts movement of the position of the conveyance guide 26 upward and to the right in FIG. 8C. Further, the guide surfaces of the guide slot 42 of the shaft support 40 are deviated from the flat surfaces of the non-circular shaft portion 27*a* of the rotation shaft 27 of the conveyance guide 26. Therefore, a gap is formed on the right side of the non-circular shaft portion 27*a* in FIG. 8C. In FIG. 8C, the lower curved surface 27*c* and the left side of the upper curved surface 27*b* of the non-circular shaft portion 27*a* are in contact with the curved surface of the circular hole part 41 of the shaft support 40. As a result, the engaged portion 32 and the rotation shaft 27 of the conveyance guide 26 is not removed in the direction opposite to the direction to install the conveyance guide 26.

This is because, as described above, the shaft support 40 includes the circular hole part 41 formed with the curved surface to rotatably support the rotation shaft 27, and the circular hole part 41 communicates with the guide slot 42. When the non-circular shaft portion 27*a* of the rotation shaft 27 is inserted into the guide slot 42 while the flat surfaces of the non-circular shaft portion 27*a* slide along the guide surfaces of the guide slot 42, the center of the circumference of the rotation shaft 27 is offset from the center of the circular hole part 41 in the direction perpendicular to the direction of insertion of the rotation shaft 27. That is, as described above, the guide surfaces of the guide slot 42 of the shaft support 40 are deviated from the flat surfaces of the non-circular shaft portion 27*a* of the rotation shaft 27 of the conveyance guide 26 installed at the first installation position. For this reason, the rotation shaft 27 is not removed in the direction of insertion of the rotation shaft 27.

That is, the shaft support 40 functions as the restrictor that restricts movement of the rotation shaft 27 inserted into the circular hole part 41 of the shaft support 40 in the direction opposite to the direction in which the rotation shaft 27 is inserted into the guide slot 42.

Further, since the flat surfaces of the non-circular shaft portion 27*a* of the rotation shaft 27 of the conveyance guide 26 is offset upstream from the guide surface of the guide slot 42 of the shaft support 40 in the sheet conveyance direction, the operability of the lever 28 when the transfer roller 20 is replaced is not deteriorated. Alternatively, the conveyance guide 26 may be arranged in the vertical direction instead of the horizontal direction.

As described above, the drum unit 10 is installed in the housing 1 in a state in which the conveyance guide 26 is positioned at the predetermined position by the position restrictor 34. As a result, the transfer roller 20 forms the transfer portion (transfer nip) together with the photoconductor drum 3.

As described above, as the non-circular shaft portion 27*a* of the rotation shaft 27 of the conveyance guide 26 is inserted into the guide slot 42 of the shaft support 40 while the flat surfaces of the non-circular shaft portion 27*a* slide along the guide surfaces of the guide slot 42, the position restrictor 34 positions the conveyance guide 26 with respect to the housing 1. Therefore, the conveyance unit 24 can be assembled simply by inserting the rotation shaft 27 of the conveyance unit 24 into the shaft support 40 of the housing 1 from above indicated by arrow A and moving the flat surfaces of the non-circular shaft portion 27*a* along the guide surfaces of the guide slot 42. That is, a comparative conveyance unit is installed in a comparative housing by two actions: first, a support shaft of the conveyance unit is inserted into a bearing of the comparative housing; and then the support shaft of the comparative conveyance unit is rotated to engage the comparative conveyance unit and the comparative housing, thereby positioning the comparative conveyance unit at a predetermined position. On the other hand, in the present embodiment, the two actions are unnecessary, and the conveyance unit can be installed from one direction, thereby facilitating the installation of the conveyance unit.

Next, a configuration in which the transfer roller 20 can be replaced by rotating the conveyance unit 24 is described.

Figure 9A:
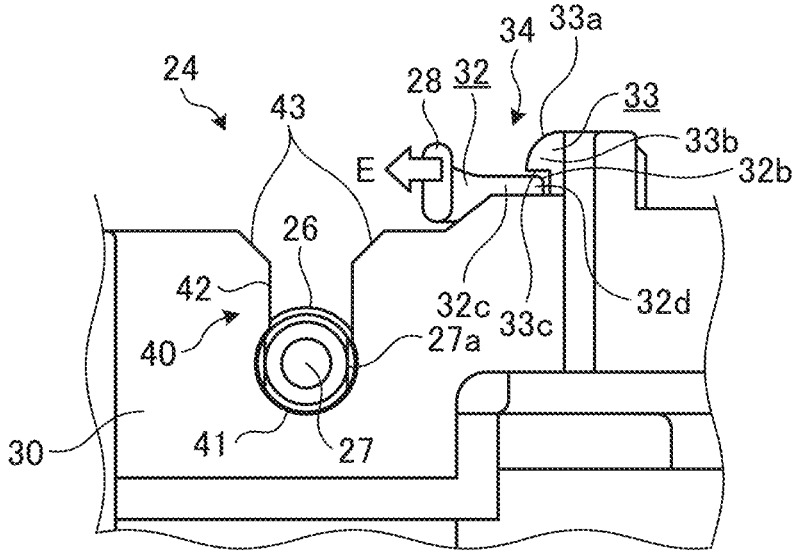
FIG. 9A is a schematic view illustrating a state immediately after start of rotation operation when a transfer roller is replaced by rotating the conveyance unit.
Figure 9B:
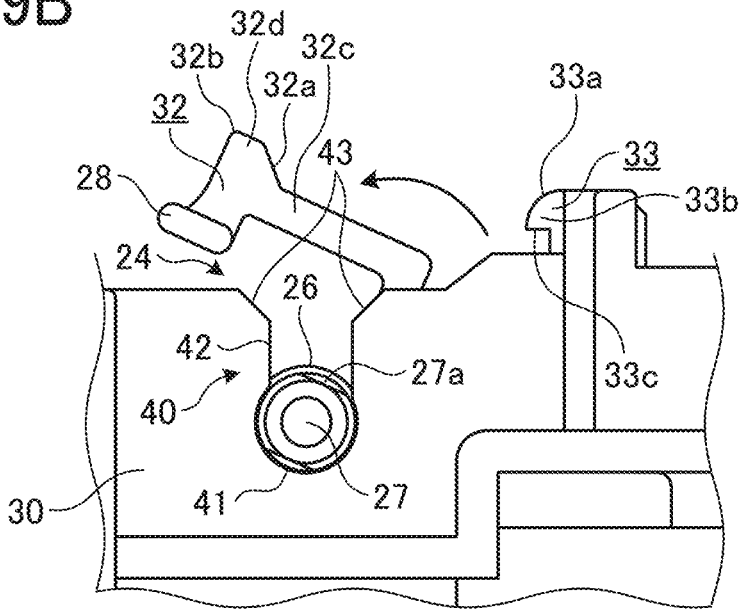
FIG. 9B is a schematic view illustrating a state in which the rotation operation has been finished when the transfer roller is replaced by rotating the conveyance unit.

FIGS. 9A and 9B are schematic views illustrating a process of replacing the transfer roller 20 by rotating the conveyance unit 24. In the present embodiment, the transfer roller 20 is replaced as follows.

FIG. 9A is a schematic view illustrating a state immediately after start of the rotation operation when the transfer roller 20 is replaced by rotating the conveyance unit 24. As illustrated in FIG. 9A, when the transfer roller 20 is replaced in a state in which the drum unit 10 is removed from the housing 1, a user accesses the lever 28 through the opening 15. As the user presses the lever 28 in the direction indicated by arrow E, the pillar base 32*c* of the engaged portion 32 is bent. As the user further presses the lever 28 in the direction indicated by arrow E, the upper end 32*b* of the engaged portion 32 starts passing through the barb 33*c* of the engagement portion 33. After the upper end 32*b* has passed through the barb 33*c* of the engagement portion 33, the projection 32*d* of the engaged portion 32 is disengaged from the barb 33*c*, which forms the recess of the engagement portion 33. As a result, the conveyance unit 24 can be rotated counterclockwise around the rotation shaft 27 with respect to the housing 1.

FIG. 9B is a schematic view illustrating a state in which the rotation operation has been finished when the transfer roller 20 is replaced by rotating the conveyance unit 24. As illustrated in FIG. 9B, as the user continues to press the lever 28 in the direction indicated by arrow E in a state in which the engagement between the projection 32*d* of the engaged portion 32 and the barb 33*c* of the engagement portion 33 is released, the conveyance unit 24 is rotated around the rotation shaft 27 of the conveyance guide 26.

Figure 10:
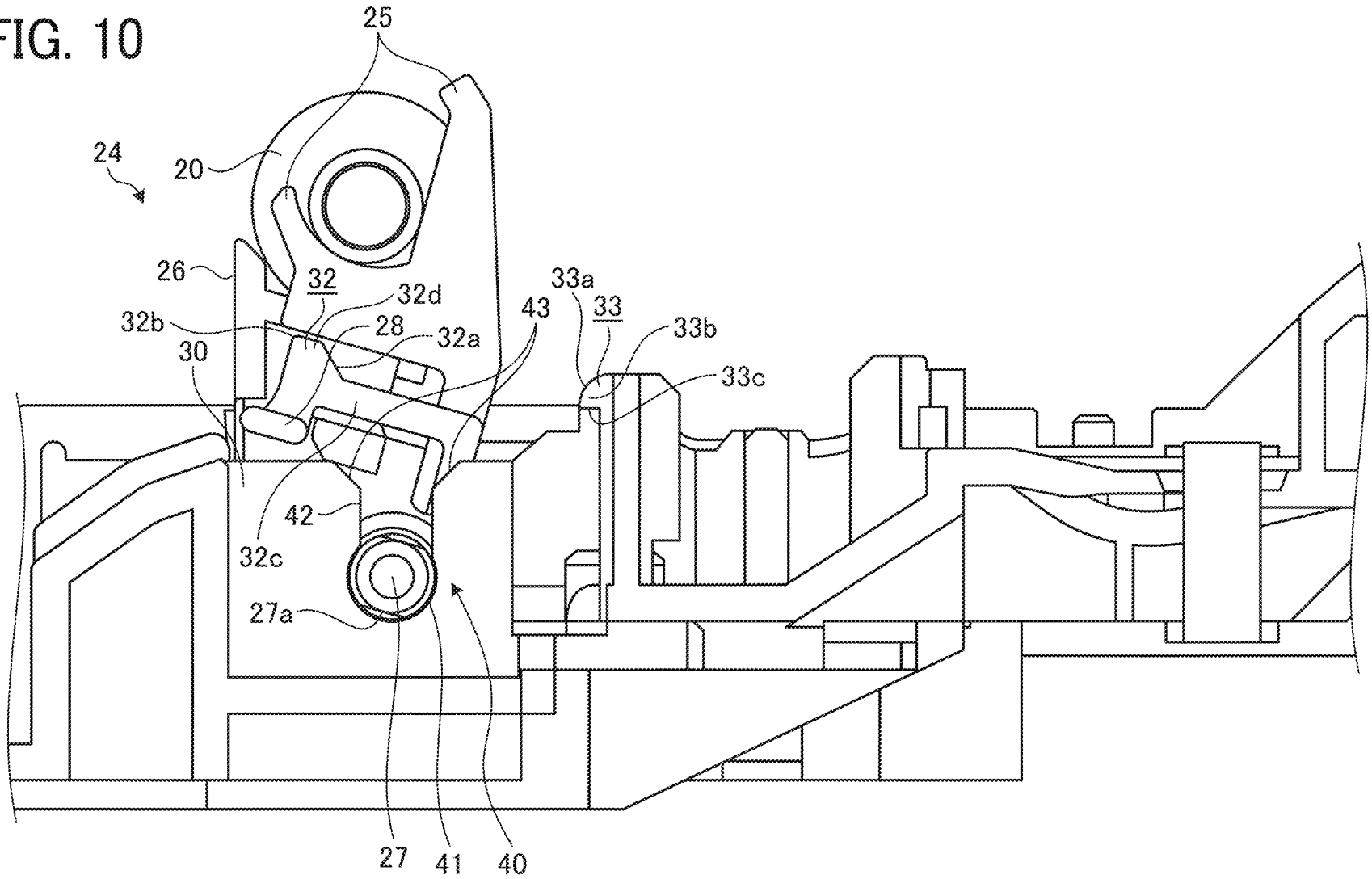
FIG. 10 is a side view of the conveyance unit when the transfer roller is replaced.

FIG. 10 is a side view of the conveyance unit 24 when the transfer roller 20 is replaced. As illustrated in FIG. 10, as the conveyance unit 24 is rotated around the rotation shaft 27 of the conveyance guide 26, the arm 25 of the conveyance unit 24 that supports the transfer roller 20 lifts and moves the transfer roller 20 toward the opening 15. Accordingly, by rotating the conveyance guide 26, the transfer roller 20 can be moved from the position at the time of image formation to the position where a user can easily replace the transfer roller 20, thereby improving the workability for the user to replace the transfer roller 20.

As illustrated in FIG. 10, when the transfer roller 20 is replaced, the flat surfaces of the non-circular shaft portion 27*a* of the rotation shaft 27 of the conveyance guide 26 and the guide surfaces of the guide slot 42 of the shaft support 40 are not parallel to each other. Therefore, the non-circular shaft portion 27*a* is inhibited from entering into the guide slot 42. This state is called a second installation position. Thus, when the transfer roller 20 is replaced, the rotation shaft 27 of the conveyance guide 26 is prevented from dropping off from the shaft support 40 as the conveyance guide 26 rotates. Therefore, the conveyance guide 26 in a state in which the rotation shaft 27 rotates in the shaft support 40 does not fall out of the predetermined range contrary to the user's intention, and the transfer roller 20 to be replaced does not come into contact with the housing 1 or the frame 30. Accordingly, the workability does not decrease subsequently.

As described above, according to the present embodiment, when the rotation shaft 27 has been inserted into the circular hole part 41 of the shaft support 40 after the flat surfaces of the non-circular shaft portion 27*a* slide along the guide surfaces of the guide slot 42, the restrictor restrains the rotation shaft 27 from moving in the direction opposite to the direction of insertion of the rotation shaft 27. More specifically, since the conveyance unit 24 (or conveyance guide 26) can be installed in the housing 1 from one direction, thereby improving the workability of assembly. In addition, after the conveyance unit 24 has been installed in the housing 1, the position restrictor 34 restricts the position of the conveyance guide 26, and the guide surfaces of the guide slot 42 of the shaft support 40 is offset from the flat surfaces of the non-circular shaft portion 27*a* of the rotation shaft 27 of the conveyance guide 26. As a result, the rotation shaft 27 of the conveyance guide 26 is not removed in the direction opposite to the direction of insertion of the rotation shaft 27, thereby improving the operability of the conveyance unit 24.

As described above, according to the present embodiment, when the transfer roller 20 is replaced, the rotation shaft 27 of the conveyance guide 26 does not fall out from the shaft support 40 along with the rotation of the conveyance guide 26, and the problem is prevented that the conveyance guide 26 drops off contrary to the user's intention. Accordingly, the workability does not decrease subsequently.

As described above, the present disclosure can improve workability to install a conveyance guide in a housing of an image forming apparatus.

Variation 1

In the above-described embodiments, the image forming apparatus 100 employing a direct transfer method in which the transfer roller 20 is opposed to the photoconductor drum 3 is described. However, the image forming apparatus is not limited to the direct transfer type, and the present disclosure can also be applied to an image forming apparatus employing an intermediate transfer method in which a secondary transfer roller faces an intermediate transfer belt.

Variation 2

In the above-describe embodiments, the transfer roller 20 is applied as the conveyance device of the conveyance unit 24. However, the conveyance device is not limited to the transfer roller 20 but can be any roller provided with a conveyance guide, a stack guide, an open/close cover, or the like, such as a registration roller that transports the recording sheet in synchronization with the toner image on a photoconductor drum to transfer the toner image to the recording sheet.

Variation 3

Additionally, the image forming apparatus 100 in the above-described embodiments employs, but not limited to, electrophotography. The present disclosure can be applied to an image forming apparatus employing any image forming method such as an ink jet method if the conveyance device is, for example, a registration roller instead of the transfer roller.

Variation 4

In the above-described embodiments, descriptions concern, but not limited to, the monochrome image forming apparatus 100 employing a direct transfer method. The present disclosure can be applied to any image forming apparatus such as a multifunction peripheral (MFP) having at least two of copy function, print function, scanner function, and facsimile transmission function, a copier, a color printer, a scanner, and a facsimile machine.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. An image forming apparatus comprising:

a conveyance device configured to transport a conveyed object;

a conveyance guide configured to guide the conveyed object to the conveyance device, the conveyance guide including a rotation shaft that includes a non-circular shaft portion;

a housing including a shaft support, the shaft support having a circular hole part and a guide slot, the circular hole part configured to rotatably support the rotation shaft, the rotation shaft configured to be insertable through the guide slot into the shaft support while a flat surface of the non-circular shaft portion slides along a guide surface of the guide slot; and a restrictor configured to restrict movement of the rotation shaft inserted into the circular hole part of the shaft support in a direction opposite to a direction of insertion of the rotation shaft into the shaft support.

2. The image forming apparatus according to claim 1, wherein the circular hole part has a curved surface and communicates with the guide slot, and wherein a center of the rotation shaft is offset from a center of the circular hole part in a direction perpendicular to the direction of insertion of the rotation shaft when the rotation shaft is inserted into the shaft support while the flat surface of the non-circular shaft portion slides along the guide surface of the guide slot.

3. The image forming apparatus according to claim 1 wherein the restrictor includes an engagement portion of the housing and an engaged portion of the conveyance guide, and wherein the engagement portion engages the engaged portion in conjunction with insertion of the non-circular shaft portion into the guide slot.

4. The image forming apparatus according to claim 3, wherein the engaged portion is configured to be displaced with respect to the engagement portion by elasticity, and wherein, based on the engaged portion having passed through the engagement portion, the engaged portion is configured to return to an original shape in which the engaged portion is not displaced, and engages the engagement portion.

5. The image forming apparatus according to claim 3, wherein the restrictor is configured to inhibit a non-circular shaft portion from entering the guide slot in a state in which an engagement between the engagement portion and the engaged portion is released and the conveyance guide is rotated with respect to the housing.

6. The image forming apparatus according to claim 1, wherein the conveyance device is a transfer roller, and wherein the transfer roller does not contact the conveyance guide when the conveyance guide is positioned where the conveyance guide guides the conveyed object to the conveyance device.

7. The image forming apparatus according to claim 6, wherein the conveyance guide includes an arm configured to support the transfer roller.

8. The image forming apparatus according to claim 6, further comprising a photoconductor drum configured to form a transfer portion together with the transfer roller, wherein the housing has an opening through which the photoconductor drum is configured to be removably installable in the image forming apparatus, and wherein the non-circular shaft portion is positioned closer to the opening than the transfer roller.

9. The image forming apparatus according to claim 1, wherein a center of the rotation shaft is offset from a center of the circular hole part in a direction perpendicular to the direction of insertion of the rotation shaft when the rotation shaft is inserted into the shaft support while the flat surface of the non-circular shaft portion slides along the guide surface of the guide slot.

10. The image forming apparatus according to claim 1, wherein the restrictor includes an engagement portion of the housing and an engaged portion of the conveyance guide.

11. The image forming apparatus according to claim 1, wherein a surface of the housing is an exterior surface of the image forming apparatus.

12. The image forming apparatus according to claim 1, wherein the restrictor includes an engaged portion which is integral to the housing.

13. A transfer device comprising:

a transfer roller;

a conveyance guide configured to guide a conveyed object to the transfer roller, the conveyance guide including a rotation shaft that includes a non-circular shaft portion;

a housing including a shaft support, the shaft support having a circular hole part and a guide slot, the circular hole part configured to rotatably support the rotation shaft, the rotation shaft configured to be insertable through the guide slot into the shaft support while a flat surface of the non-circular shaft portion slides along a guide surface of the guide slot; and a restrictor configured to restrict movement of the rotation shaft inserted into the circular hole part of the shaft support in a direction opposite to a direction of insertion of the rotation shaft into the shaft support.

14. The transfer device according to claim 13, wherein the circular hole part has a curved surface and communicates with the guide slot, wherein a center of the rotation shaft is offset from a center of the circular hole part in a direction perpendicular to the direction of insertion of the rotation shaft when the rotation shaft is inserted into the shaft support while the flat surface of the non-circular shaft portion slides along the guide surface of the guide slot.

15. The transfer device according to claim 13, wherein the restrictor includes an engagement portion of the housing and an engaged portion of the conveyance guide, and wherein the engagement portion engages the engaged portion in conjunction with insertion of the non-circular shaft portion into the guide slot.

16. The transfer device according to claim 15, wherein the engaged portion is configured to be displaced with respect to the engagement portion by elasticity, and wherein, based on the engaged portion having passed through the engagement portion, the engaged portion is configured to return to an original shape, in which the engaged portion is not displaced, and engages the engagement portion.

17. The transfer device according to claim 15, wherein the restrictor is configured to inhibit the non-circular shaft portion from entering the guide slot in a state in which an engagement between the engagement portion and the engaged portion is released and the conveyance guide is rotated with respect to the housing.

18. The transfer device according to claim 13, wherein the transfer roller does not contact the conveyance guide when the conveyance guide is positioned where the conveyance guide guides the conveyed object to the transfer roller.

19. The transfer device according to claim 13, wherein the conveyance guide includes an arm configured to support the transfer roller.

20. An image forming apparatus comprising the transfer device according to claim 13.

* * * * *